US007884498B2

(12) United States Patent
Ecker et al.

(10) Patent No.: US 7,884,498 B2
(45) Date of Patent: Feb. 8, 2011

(54) METHOD AND ARRANGEMENT FOR THE ENERGY-SAVING OPERATION OF DISHWASHERS

(75) Inventors: Engelbert Ecker, Offenburg (DE); Marcus Eggs, Offenburg (DE); Dietmar Zapf, Willstätt (DE); Michael Streb, Iffezheim (DE)

(73) Assignee: Meiko Maschinenbau GmbH & Co KG, Offenburg (DE)

( * ) Notice: Subject to any disclaimer, the term of this patent is extended or adjusted under 35 U.S.C. 154(b) by 892 days.

(21) Appl. No.: 10/583,963

(22) PCT Filed: Aug. 25, 2005

(86) PCT No.: PCT/EP2005/009189

§ 371 (c)(1),
(2), (4) Date: Mar. 21, 2007

(87) PCT Pub. No.: WO2006/034760

PCT Pub. Date: Apr. 6, 2006

(65) Prior Publication Data

US 2009/0151750 A1 Jun. 18, 2009

(30) Foreign Application Priority Data

Sep. 24, 2004 (DE) ..... 10 2004 046 758

(51) Int. Cl.
*H02J 3/14* (2006.01)

(52) U.S. Cl. ..... 307/35

(58) Field of Classification Search ..... 307/35
See application file for complete search history.

(56) References Cited

U.S. PATENT DOCUMENTS 4,160,153 A 7/1979 Melander (Continued)

FOREIGN PATENT DOCUMENTS

DE 514355 12/1930

(Continued)

OTHER PUBLICATIONS

Vergleichsmessungen zu diversen Spulmaschinen der Reihe EKUMATIC der Firma EKU-Metallbau, Mar. 9, 2001 (English text summary provided).

*Primary Examiner*—Jared J Fureman
*Assistant Examiner*—Dru M Parries
(74) *Attorney, Agent, or Firm*—Birch, Stewart, Kolasch & Birch, LLP

(57) ABSTRACT

In a method and an apparatus for operation of a dishwasher, a total maximum electric output is assigned to a group of electric consumer elements of the dishwasher. In addition, at least two output levels are assigned to each electric consumer element of said group. An optimum combination of output levels is then selected in a requirement determination step, based on an operational state B of the dishwasher, whereby for each consumer element the selected output level is adapted to the output requirement of the consumer element in operational state B and the total output of all consumer elements does not exceed the maximum electric total output. The output levels of the individual consumer elements are optimally adapted in accordance with the requirements in operating phases of the dishwasher, thus allowing a response to be made to any fluctuations in the operational state.

16 Claims, 4 Drawing Sheets

U.S. PATENT DOCUMENTS

| | | | | |
|---|---|---|---|---|
| 4,213,313 | A * | 7/1980 | Kiefer et al. | 68/12.01 |
| 4,561,904 | A | 12/1985 | Eberhardt, Jr. et al. | |
| 4,689,089 | A | 8/1987 | Eberhardt, Jr. et al. | |
| 4,695,738 | A | 9/1987 | Wilmot | |
| 4,915,162 | A | 4/1990 | Ikura | |
| 4,935,642 | A | 6/1990 | Obelode et al. | |
| 5,307,440 | A | 4/1994 | Carretto | |
| 5,543,667 | A | 8/1996 | Shavit et al. | |
| 5,883,802 | A | 3/1999 | Harris | |

FOREIGN PATENT DOCUMENTS

| | | | |
|---|---|---|---|
| DE | 27 12 020 | A1 | 9/1978 |
| DE | 30 45 023 | A1 | 1/1982 |
| DE | 36 01 665 | A1 | 7/1987 |
| DE | 41 24 650 | A1 | 1/1993 |
| DE | 94 08 167 | U1 | 6/1995 |
| DE | 44 36 359 | A1 | 4/1996 |
| DE | 198 42 043 | B4 | 3/2000 |
| EP | 1 184 768 | A2 | 3/2002 |
| WO | WO 95/29572 | A1 | 11/1995 |
| WO | WO 00/52806 | A1 | 9/2000 |

* cited by examiner

METHOD AND ARRANGEMENT FOR THE ENERGY-SAVING OPERATION OF DISHWASHERS

FIELD OF THE INVENTION

The invention relates to a method and an arrangement by means of which dishwashers can be operated with more energy being saved. One particular aim of the invention is to allow energy-saving operation of multiple tank dishwashers with washing zones, a rinsing zone and a drying zone.

PRIOR ART

Known machines, such as the dishwashing and drying installation described in DE 44 36 359 C2, typically have heaters installed for the individual loads, that is to say for the individual zones. These heaters are sufficient to cover the respective worst-case power demand. The worst-case power demand is in this case that amount of power which is required for the rated power of the machine.

The heating power levels in the individual zones differ, depending on the method being used. The installed heating power levels are in each case switched on and off depending on the instantaneous power demand. The addition of the heating power levels which are required for the rated power in each case results in the maximum connection level.

By way of example, FIG. 1 illustrates a multiple tank dishwasher 110 corresponding to the prior art. In these dishwashers, the item 9 being washed is passed to a transport device 11 in the inlet 1, and is then transported in the direction 10 through zones of precleaning 2, main cleaning 3, pump rinsing 4, fresh-water rinsing 5, heat recovery 6, dry zone 7 and the outlet 8.

Once the machine 110 has been switched on, the respective cleaner solution in the tanks 13, 17, 21 is provided in the zones 2, 3, 4 and is raised to the operating temperature by means of heaters 14, 18, 22. The machine is ready to operate once respectively preset nominal-value temperatures have been reached in the tanks 13, 17, 21.

The transport can then be switched on, with the item 9 being washed being placed on the transport device 11, and then being transported through the zones 1 to 8. During this process, the item 9 being washed has appropriate cleaning solutions applied to it via pumps 15, 19, 23 and via the washing systems 16, 20, 24, and is cleaned.

The item 9 being washed has fresh water applied to it via a spraying system 28 in the fresh-water rinsing 5, with this fresh water previously having been heated via a heat exchanger 29 and a heating element 26. Residues of the cleaning solutions are washed away during this process. Fresh water is preheated in the heat exchanger 29 by means of hot exhaust air 31 from the dishwasher 110. The fresh water is then heated further in a heating element 26, in order then to be supplied to the spraying system 28.

After being rinsed in the zone 5, the item 9 being washed then has hot air 34 applied to it in the dry zone 7 via a fan 32 and a heater 33, and is thus dried. The cleaned, rinsed and dried item 9 being washed is then removed in the outlet 8 of the dishwasher 110.

By way of example, Table 1 lists typical power levels of loads in the illustrated machine 110. In this case, only the power levels of the heating elements 14, 18, 22, 26 and 33 are listed, for simplicity. This simplified example ignores the power levels required for the pumps 15, 19 and 23 used for the spraying systems 16, 20 and 24, as well as the drive power required for driving the transport device 11, the exhaust-air fan 30, the fan in the dry zone 32 and further loads that are not illustrated. The connection level for the heating elements in this example corresponding to the prior art results in a total power of 47 kW.

Only the heaters 14, 18 and 22 are typically switched on in the phase of heating the tanks 13, 17 and 21. This results in a power level in the heating-up phase (starting phase) of 12+9+3=24 kW. The heating elements 26 and 33 are in this case typically not switched on. This 24 kW results in a typical heating-up time for the tanks 13, 17 and 21 and thus a specific predetermined time before the dishwasher 110 is ready to operate.

During the operating phase, the heaters 26 and 33 are then additionally switched on, with an additional heating power of 18 and 9 kW, respectively, in order to heat the fresh water and the drying air. In this operating phase, all of the heating elements 14, 18, 22, 26 and 33 are then switched on and off depending on whether the respective predetermined nominal temperatures have or have not been reached in these zones. If the predetermined nominal temperatures have not been reached, only the installed power levels are in each case available for subsequent heating. The heating powers of the heating elements 14, 18, 22, 26 and 33 are typically switched on and off at different times.

Dishwashers of the described type have numerous disadvantages which generally result from the operation of dishwashers such as these being very inefficient in terms of energy use. These disadvantages are thus associated in particular with the fact that the amount of electrical power supplied must not exceed a predetermined maximum value. This maximum value governs, in particular, the design of the electrical supply cables and the electronics. The individual loads in the dishwasher are generally matched to the respective demand independently of one another, so that all of the loads are operated at the maximum power in the worst case. Loads are in this case typically operated in such a way that they are either switched off or switched on at a predetermined power level. The maximum value of the total supplied power must therefore be matched to this "worst case", in which all the loads are operated at the maximum power level.

Furthermore, dishwashers of the described type are frequently found to be very slow and cumbersome, particularly in the starting phase before they are ready to operate. This is particularly due to the fact that critical heating elements which, for example, are intended to control the operating temperature being reached in the tanks 13, 17 and 21 can be operated only at a respectively predetermined maximum power resulting from the abovementioned "worst case" scenario.

OBJECT OF THE INVENTION

The object of the invention is thus to specify a method and an arrangement by means of which dishwashers can be designed such that more energy is saved and they are more flexible.

DESCRIPTION OF THE INVENTION

This object is achieved by the invention with the features of the independent claims. Advantageous developments are described in the dependent claims.

A method is proposed for energy-saving operation of a dishwasher, in particular for washing dishes or medical appliances, as well as an apparatus for in each case carrying out the method in one of the described refinements. The dishwasher may, in particular, be a multiple tank dishwasher. The method steps described in the following text need not necessarily be carried out in the described sequence. Further method steps, which are not included, may also be carried out. Reference is made to FIG. 2 for the numbering of the method steps.

The dishwasher should have a total number $N \geqq 2$ of electrical load elements. As already described above, these load elements may, for example, be heating elements, pump elements, fans or drive elements. Further load elements may also be included, for example power supplies for controllers or computers.

In this case, a group of n electrical load elements is assigned a maximum electrical total power $p_{max}$ (step 210 in FIG. 2), where n is a natural number and $n>1$. Furthermore, n should be less than or equal to the total number N of electrical load elements in the dishwasher: $n \leqq N$. All or else only some of the load elements in the dishwasher can thus also be included in the method.

Furthermore, each electrical load element i in the group of n electrical load elements is assigned a finite number $m_i$ of discrete electrical power levels $p_{ij}$ (step 220 in FIG. 2). In this case, $m_i$ should assume at least the value 2. The first index i of the discrete electrical power levels $p_{ij}$ is a natural number which successively numbers the electrical load elements, and in which case $i \in \{1, \ldots, n\}$. The individual power levels for a specific load i are numbered successively by the second index j. In this case, j is likewise a natural number, which is greater than zero and can assume the maximum value $m_i$: $0<j \leqq m_i$.

A maximum power level $p_{imax}$ is assigned to each load element i, so that $p_{ij}$ can assume at most the value $p_{imax}$ for all i, j. The sum of all the maximum power levels $p_{imax}$ forms a so-called "worst-case total power" $p_{worst}$. In this case, the maximum electrical total power $p_{max}$ should be less than the worst-case total power $p_{worst}$. In contrast to the prior art, in which $p_{worst}$ is typically shared directly between the individual load elements, this condition ensures that the total power demand of the dishwasher is reduced.

Furthermore, each load element i is assigned a so-called "regular power level" $p_{ireg}$, which is between zero and the respective maximum power level $p_{imax}$. These regular power levels are in fact chosen such that the sum of the regular power levels $p_{ireg}$ over all the load elements i is just equal to the maximum electrical total power $p_{max}$. The maximum electrical total power is thus "shared" between the individual load elements i.

Furthermore, a so-called "demand determination step" is carried out (step 230 in FIG. 2). In this case, an optimum combination of power levels $p_{ij}(B)$ is selected depending on the operating state B of the dishwasher, with the selected power level $p_{ij}(B)$ for each load element i being matched to the power demand of the load i in the operating state B.

By way of example, an operating state is in this case characterized by an operating phase in which the dishwasher is actually being operated (for example the starting phase, switched-on phase, load regulation phase) or, for example additionally, by corresponding operating parameters or operating state variables, for example by means of measured values of specific sensors in the dishwasher (for example temperature sensors, flow sensors, pressure sensors). By way of example, each operating state B can thus be characterized by an operating state variable F and/or by a plurality of operating state variables, in which case the operating phase variable F may assume at least three discrete values $F_1$, $F_2$, $F_3$. In this case, $F_1$ denotes a starting phase of operation of the dishwasher, $F_2$ a switched-on phase of operation of the dishwasher, and $F_3$ a load regulation phase of operation of the dishwasher.

By way of example, in the demand determination step, more power can be supplied to specific heating elements in a starting phase than in a subsequent operating phase. Furthermore, the power levels $p_{ij}(B)$ are selected such that the sum of all the power levels $p_{ij}(B)$ assumes at most the value $p_{max}$. Ideally, the method is in this case carried out such that this sum just reaches the value $p_{max}$ again, or is only slightly less than it, so that the total available power is optimally used. This ensures that, as in the case of the prior art as well, each heating element is operated with its maximum permissible power, when required.

In contrast to the prior art, however, other load elements for which there is little requirement at that time have correspondingly less power applied to them in this case. The power is thus distributed, controlled by the respective demand, in accordance with the discrete power levels $p_{ij}$ of the individual load elements, in which case the total sum of the power levels is in each case as high as possible, and the greatest possible power is applied at any given instant to the heaviest required load. In this case, priorities can also be preset, that is to say by way of example that the maximum possible power should initially be allocated to specific heating elements in the dishwasher, in particular specific heating elements which heat water in one or more water tanks and/or water circuits, before power is applied to other elements with a lower priority.

In practice, the demand-dependent allocation of electrical power levels can be carried out, for example, by using a computer for control purposes. By way of example, specific scenarios (operating states, value ranges of operating state variables) can be stored in an electronic memory, for example in an electronic table or look-up table. Each possible scenario or operating state B can be allocated an optimum set of power levels simply by reading the electronic table, so that the sum of these allocated power levels as far as possible reaches the maximum permissible total power $p_{max}$, or is below it only to the least possible extent.

The fixed power levels can in practice be achieved, for example, by providing fixed power levels in the individual electrical supplies to the individual load elements themselves, between which it is just necessary to switch. For example, specific voltage dividers with fixed predetermined divider stages can be used. There is then no need for complex and expensive analog regulators. Alternatively and/or additionally, a software solution could also be used, or analog power regulators.

In practice, it has been found to be particularly advantageous to also be able to use a power level zero, that is to say when a power level for each load element exists for which no electrical power is applied to that load element. Furthermore, it is advantageous for three and only three power levels to be provided for each load element, in particular zero, $p_{ireg}$ and $p_{imax}$. This simple refinement can be implemented particularly easily in the circuitry and in its own right has all of the advantages of the invention.

Once the optimum combination of power levels has been determined in this way for the respective operating state, each load i has the respective power determined for it applied to it (step 240 in FIG. 2). In this case, it should be noted that the allocation of the power in practice highly probably never corresponds completely exactly to the respective nominal value for example because technical tolerances (for example tolerances in electronic components) can result in minor discrepancies. However, the discrepancies in the power levels which are actually applied to the loads from the respective nominal value are advantageously no more than 10%, and preferably even no more than 5%.

The described method, in which the maximum electrical supplied power is governed not by the sum of the maximum individual power levels but by the sum of the "normal" power levels, offers a number of advantages over conventional methods. In particular, the described method typically makes it possible to save 20-30% of the power, which is actually financially significant in large concerns.

Furthermore, the described method also in some cases has a considerable influence on the functionality of the dishwasher. For example, the described method can be used to considerably shorten, in particular, the starting phase or heating-up phase, that is to say the phase between the dishwasher being brought into use and it actually being ready to operate. This not only results in better user friendliness, but in turn also reduces the total energy demand since the starting phase cannot be used in a financially worthwhile manner despite the demand for electrical energy.

The method described above can be extended by a number of advantageous refinements, with the aim of always observing the relationships described above between the individual characteristic variables, in particular between the various power levels of the individual load elements. This means in particular that the total sum of the assigned power levels for the individual loads should not exceed the maximum permissible total power $p_{max}$.

In one advantageous refinement of the invention, the dishwasher is thus started first of all, thus marking a starting phase. At least one temperature of at least one washing liquid, in particular a temperature of water in at least one water tank and/or water circuit, is then detected. In particular, this may be done by means of one or more temperature sensors.

The at least one washing liquid is then heated by means of at least one heating element, with the respective heating element being used for heating purposes (which represents the load element l where $l \in \{1, \ldots, n\}$) being operated at the maximum power level $p_{imax}$ associated with this heating element. The maximum possible electrical power is thus initially supplied to the heating elements that are required for the starting phase. However, in order to ensure that the total sum of the individual power levels of the load elements does not exceed the maximum permissible total power $p_{max}$, the power for at least one further load element, which is not required to such a major extent in the starting phase, must be reduced appropriately. At least one load element q, which is not the same as the heating element l, where $q \in \{1, \ldots, n\}$ and $q \neq 1$ is thus operated at a lower power level than the regular power level $p_{qreg}$ associated with this load element q. By way of example, this may be the power level $p_{qreg}=0$, that is to say the load element which is required to a lesser extent is completely switched off.

As soon as the at least one temperature of the at least one washing liquid reaches or has exceeded a predetermined nominal value, a switched-on phase is then started. In this switched-on phase, the power of all the load elements i is then initially set to the respectively associated regular power level $p_{ireg}$.

As a result, for example, of various disturbances or environmental influences, it is, however, possible for disturbances to occur during operation of the dishwasher, in the event of which, for example, specific temperatures in various areas fall below a predetermined nominal value. In one advantageous development, at least one operating state variable is thus detected, in which case, as already mentioned above, this may by way of example be the measured values from various sensors.

A nominal value is allocated to at least one operating state variable. This may, for example, be preset nominal values, for example nominal values stored in a data memory or in an electronic table, or else nominal values which can be influenced by a user. By way of example, a user can thus vary specific nominal presets during operation of the machine, for example the temperature in specific areas of the machine, thus making it possible to influence the operation of the dishwasher.

If it is found (for example by means of a simple comparator) that the value of the at least one operating state variable differs by more than a predetermined tolerance from the respectively associated nominal value, a load regulation phase is started. This load regulation phase may, for example, be designed such that at least one load element r where $r \in \{1, \ldots, n\}$ which influences the corresponding incorrect operating state variable is operated at a power level other than the regular power level $p_{rreg}$.

By way of example, if it is found that the temperature in a liquid tank is excessively low, it is thus possible to temporarily operate a heating element which heats the liquid in this tank at an increased power level, for example at the maximum associated power $p_{imax}$. As described above, the power of at least one further load element must, of course, be reduced in this case in order to ensure that the total sum of the power levels does not exceed the maximum total power $p_{max}$. Once again, this allocation of power levels can be carried out, for example, by an appropriate set of power levels for this scenario being stored in an electronic table.

This load regulation operation is continued until the at least one operating state variable once again assumes a value which differs by not more than the predetermined tolerance from its nominal value.

Furthermore, the scope of the invention covers a computer program which carries out one of the embodiments of the method according to the invention when run on a computer or computer network.

The scope of the invention also covers a computer program with program-code means in order to carry out one of the refinements of the method according to the invention when the program is run on a computer or a computer network. In particular, the program-code means may be stored on a computer-legible data storage medium.

Further details and features of the invention will become evident from the following description of preferred exemplary embodiments in conjunction with the dependent claims. In this case, the respective features can be implemented in their own right or in groups of two or more combined with one another. The invention is not restricted to the exemplary embodiments.

The exemplary embodiments are illustrated schematically in the figures. The same reference numbers in the individual figures in this case denote identical or functionally identical elements, or elements whose functions correspond to one another. In detail:

Figure 1:
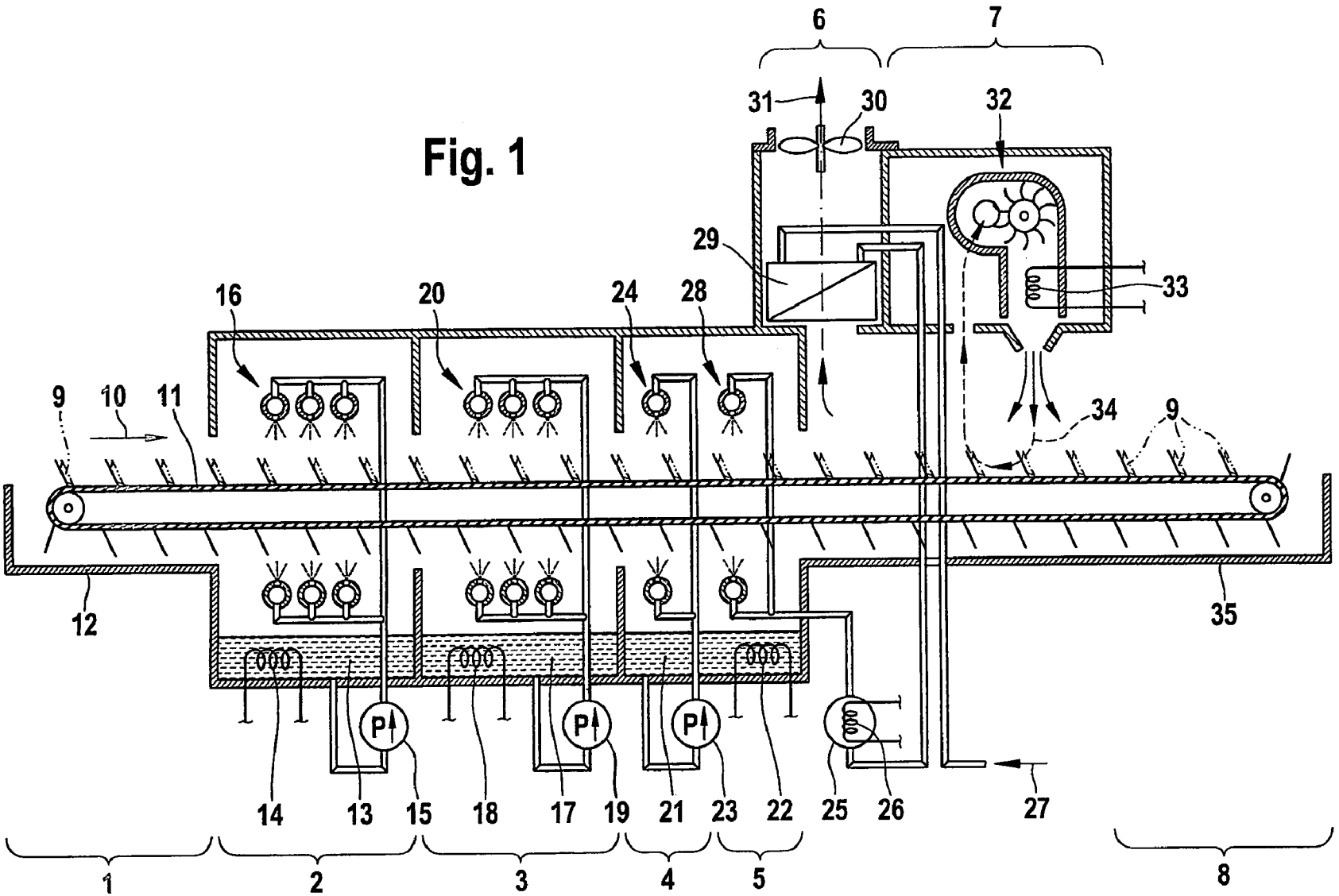
FIG. 1 shows a belt transport dishwasher corresponding to the prior art.
Figure 2:
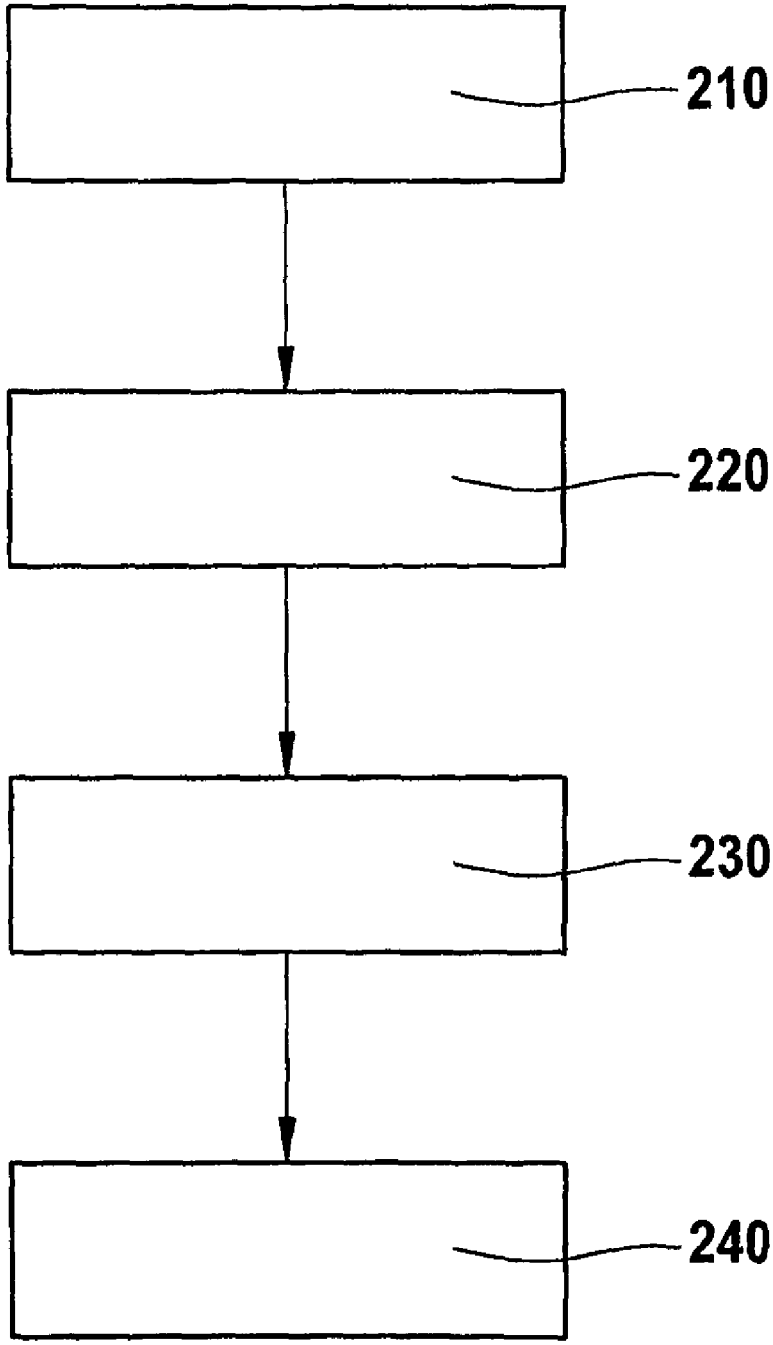
FIG. 2 shows a flowchart of one simple refinement of the method according to the invention.
Figure 3:
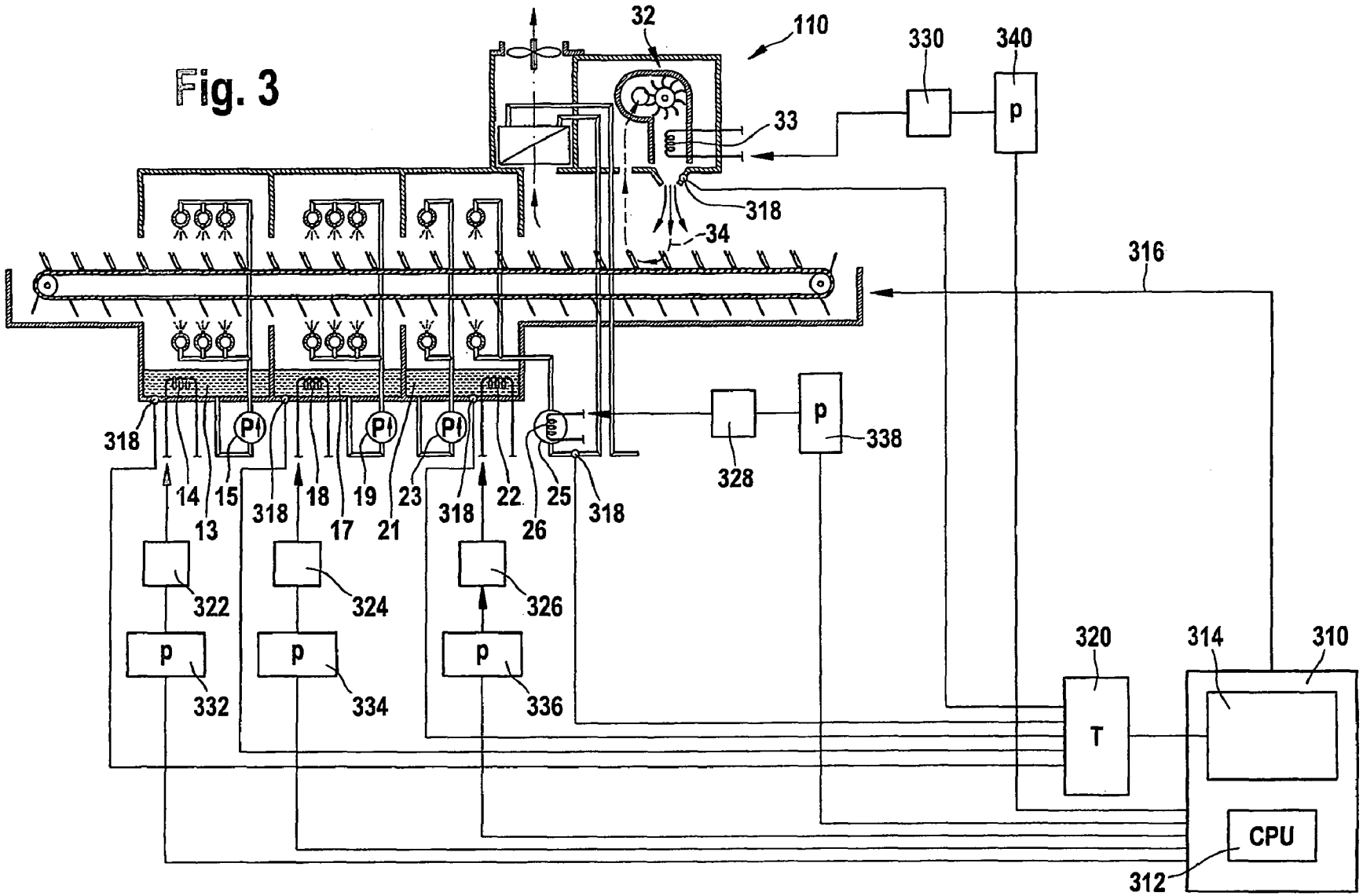
FIG. 3 shows a schematic arrangement for carrying out the described method with a belt transport dishwasher.

FIG. 3 illustrates one preferred arrangement, by means of which the method as described above can be carried out. The apparatus has a continuous-flow dishwasher, specifically a belt transport dishwasher, analogous to the dishwasher 110 illustrated in FIG. 1. The illustrated elements correspond to the respective elements of the dishwasher 110 in FIG. 1, and their functions are the same as them. Alternatively, further types of dishwashers could also be used. In addition, the arrangement in FIG. 3 has a computer system with a central processor unit 312 and a data memory 314 (for example a volatile or non-volatile memory). The computer system 310 is connected via a main controller 316 to the dishwasher 110, so that all of the major functions of the dishwasher can be controlled via the computer system 310.

Furthermore, the apparatus illustrated in FIG. 3 has a plurality of temperature sensors 318, which can detect the temperature in the liquid tanks 13, 17 and 21 as well as in the air flow 34 of the fan 32, as well as at various points in the liquid system 28 for the fresh-water rinsing 28. Further temperature sensors as well as additional sensors, for example for pressure or flow rate, can be fitted at various points in the system. The data measured by the temperature sensors 318 is detected by means of a central measured-data detection unit 320, is digitized and is made available to the computer system 310.

Furthermore, in this exemplary embodiment, the system has five electrical power supplies 322, 324, 326, 328 and 330, which supply electrical power to the heating elements 14, 18, 22, 26 and 33. The electrical power supplies 322, 324, 326, 328 and 330 are each connected to respective externally controllable electrical power regulators 332, 334, 336, 338 and 340. These externally controllable electrical power regulators 332, 334, 336, 338 and 340 control the electrical power from the electrical power supplies 322, 324, 326, 328 and 330 and are themselves in turn connected to the computer system 310, and can be controlled via it.

In addition to the heating elements 14, 18, 22, 26 and 33, pumps 15, 19 and 23 are also provided with corresponding power regulators, which can be controlled by the computer system. These power regulators are not illustrated in FIG. 3, for simplicity.

The described method can be carried out by means of the arrangement as illustrated in FIG. 3, by way of example as follows. The maximum total power $p_{max}$ for which the overall system is designed is assumed in this example to be 45 kW. First of all, specific power levels are allocated to the individual load elements. These power levels are typically preset, in which case, for example, different electrical circuits, in particular in the externally controllable power regulators 332, 334, 336, 338 and 340 and in the power regulators for the pumps 15, 19 and 23, which are not illustrated, can be used. It is possible to switch between these individual electrical circuits, controlled by the computer system 310, so that different power levels can be applied to the respectively associated loads 14, 18, 22, 26, 33, 15, 19 and 23.

By way of example, Table 2 shows an allocation such as this of discrete power levels to the individual load elements. In this case, the load element with the associated reference symbol is in each case shown in the first column. The respective discrete power levels are listed in the second column. All of the power levels are stated in kilowatts. In this case, in this simple example, the heating elements 14, 18, 22 and 26 each have three power levels, specifically $p_{imax}$, $p_{ireg}$ and $p_{imin}$. The pumps 15, 19 and 23 in this example have only two power levels, specifically $p_{imax}=p_{ireg}$ and $p_{min}$. The lowest power level $p_{imin}$ is set to the value zero in this example for all of the listed loads.

Examples for power levels in various operating phases are shown in the third, the fourth and the fifth column, specifically in the starting phase (third column), the switched-on phase (fourth column) and the load regulation phase. Typical numerical values for this example are illustrated in the fourth column, based on a conventional control method for the dishwasher 110 illustrated in FIG. 3.

In the starting phase, that is to say immediately after the dishwasher 110 has been brought into use, the water tanks 13, 17 and 21 must be raised to the required operating temperature, before the washing operation of the machine can be started. In this starting phase, the maximum power is thus allocated to the heating elements 14, 18 and 22. The heating 26 for the continuous-flow heater, the drying heating 33 and the pumps 15, 19 and 23 are in contrast not yet required in this starting phase, and are thus set to the minimum power, that is to say in this case to a power level of zero. Overall, the total power level for all of the loads in this starting phase is calculated to be a power of 45 kW, which thus corresponds exactly to the predetermined maximum value $p_{max}$. Alternatively, the sum of the individual powers could also be less than $p_{max}$, but in no case more than it.

As soon as the signal from the temperature sensors 318 indicates that the predetermined nominal temperatures (which for example are stored in the data memory 314 in the computer system 310) have been reached in the tanks 13, 17 and 21, the computer system 310 initiates the switched-on phase. Various intermediate phase are also feasible, in which, for example, the temperature in individual tanks has already reached the nominal value, but has not in others.

In the switched-on phase, the regular power values $p_{rireg}$ are then first of all applied to all of the loads. As is once again shown in the lowest line of Table 2, the sum of these $p_{rireg}$ regular power levels is also 45 kW in this case. Once again, as an alternative, the sum of the individual power levels could also be less than $p_{max}$, but in no case greater than it. The washing process can then be carried out in the dishwasher in the switched-on phase, and the machine is ready to operate.

If the computer system finds in the switched-on phase that one or more of the detected sensor values, for example the measured values from individual temperature sensors 318, have risen above or fallen below predetermined nominal values (which by way of example are once again stored in the data memory 314) by more than respectively likewise stored tolerance values, then the computer system 310 switches over to a load regulation phase. Depending on the nature of the discrepancy, appropriate action instructions in the form of power levels for corresponding loads can, for example, be stored in one or more look-up tables in the data memory 314.

As a simple example, the fifth column in Table 2 thus shows a situation as to how, for example, it would be possible to react to an increased temperature in the precleaning tank 13 and to a temperature in the main cleaning tank 17 that is lower than the associated nominal value. The power of the heating element 14 is set in an appropriate manner from the regular value of 9 kW to the minimum value of 0 kW, while in contrast the power of the heating element 18 is raised from the regular value of 6 kW to the maximum value of 15 kW. As is also evident from the last line in Table 2, the total sum of the powers applied in this case is 43 kW, that is to say slightly below the maximum permissible value of 45 kW. However, in this case, no power level for a load element is set to a higher power level than that which would exceed the maximum permissible total power $p_{max}$. Thus, the available power range is therefore optimally used in this case as well.

As soon as the computer system 310 finds that the predetermined nominal values have been reached again (except for appropriate tolerable discrepancies), a switchover is once again carried out to regular switched-on operation. If discrepancies are found again, then the described process of load regulation is repeated as appropriate.

For comparison, the last column in Table 2 also shows corresponding power levels of conventional systems, in which only one specific load can in each case be switched on or off. As can be seen, a total power of 78 kW can occur in the worst case here, for which the system must be designed.

Figure 4:
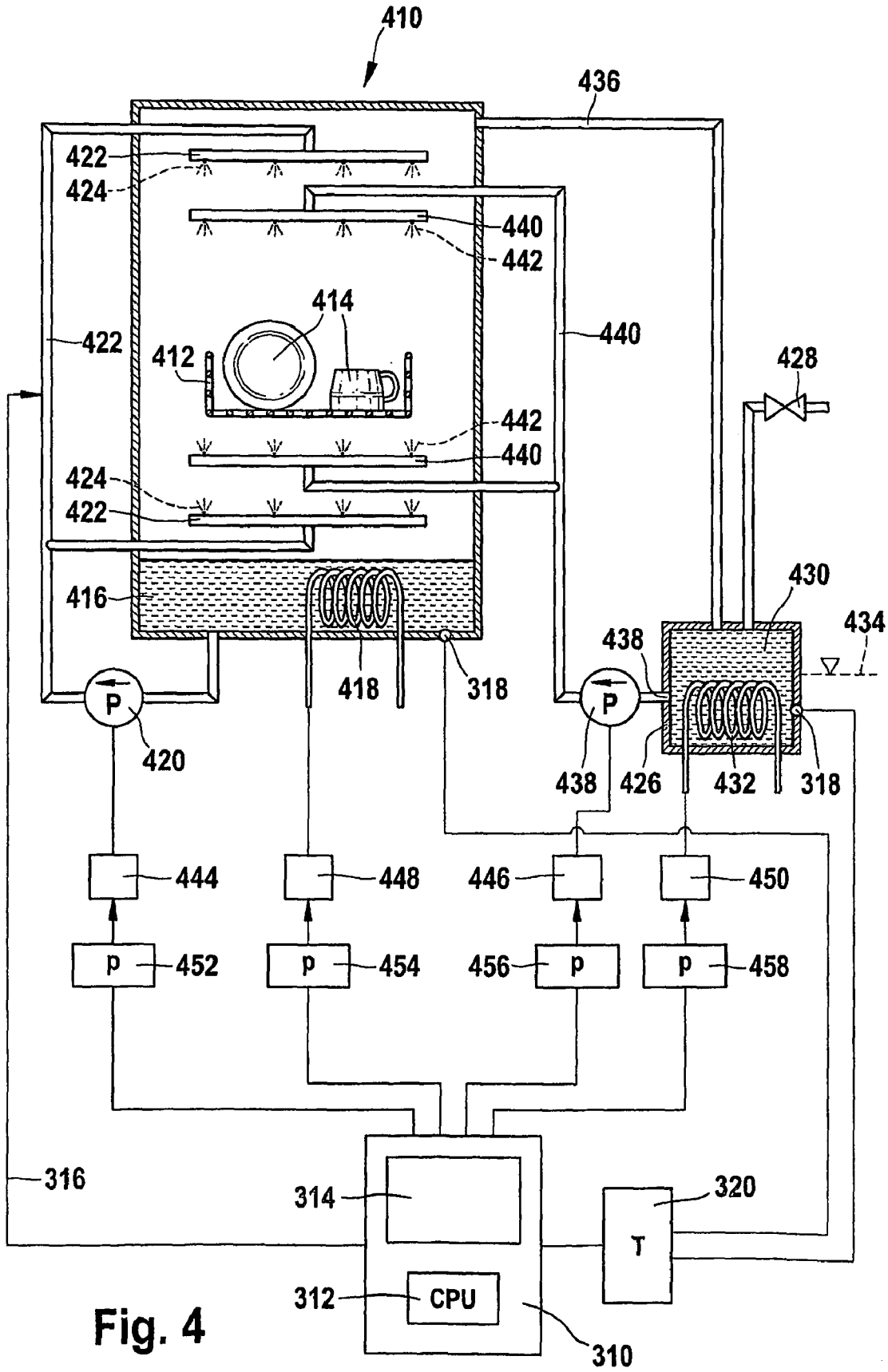
FIG. 4 shows a schematic arrangement relating to the described method being carried out with a single-chamber dishwasher.

Analogously to the example, as illustrated in FIG. 3, of a multiple chamber dishwasher, the method can also be transferred to single-chamber dishwashers, or to further dishwasher types. One corresponding arrangement is illustrated in FIG. 4.

The arrangement has a single-chamber dishwasher 410, which may, for example, be a front-loading single-chamber dishwasher or a through-feed machine. A basket 412 is held in the single-chamber dishwasher 410 in order to hold the item 414 to be washed. Furthermore, the dishwasher 410 has a tank 416 for washing lye, which can be heated via a heating element 418. Washing liquid can be applied to the item 414 to be washed from this tank for washing lye 416, by means of a circulation pump 420 and via a washing system for washing lye 422, which is provided with a plurality of nozzles 424.

Furthermore, the dishwasher 410 has a fresh-water tank 426, which is in the form of a boiler. The fresh-water tank 426 can be filled with fresh water 430 via a filling valve 428. In addition, the fresh-water tank has a heating element 432, by means of which the fresh water 430 can be heated for rinsing at increased temperatures. The fresh-water tank 426 is in this case always filled with fresh water 430 as far as the level 434 at which the heating element 432 is covered. In order to avoid overpressure in the fresh-water tank 426 during heating, the fresh-water tank 426 is connected to the interior of the dishwasher 410 via a vent line 436.

Fresh water 430 is sucked out of the fresh-water tank 426 at the induction point 438 in order to rinse the item 414 being washed with cold or else with heated fresh water 430, by means of a fresh-water pump 438, and is supplied to the item 414 to be washed via a washing system for fresh water 440 and a plurality of nozzles for rinsing 442.

Analogously to the example illustrated in FIG. 3, the arrangement shown in FIG. 4 also once again has a computer system 310 with a central processor unit 312 and a data memory 314. The computer system is connected via a main control line 316 to the dishwasher 410, so that all the major functions of the dishwasher 410 can be controlled via the computer system 410. In addition, the arrangement has two electrical power supplies 444, 446 for the pumps 420 and 438, as well as electrical power supplies 448 and 450 for the heating elements 418 and 432. The functions of the electrical power supplies 444, 446, 448, 450 correspond to that of the power supplies 322, 324, 326, 328, 330 in FIG. 3. The power of the electrical power supplies 444, 446, 448, 450 can once again be set by means of externally controllable electrical power regulators 452, 454, 456, 458, which can once again be driven by the computer system 310.

Furthermore, the tanks 416 and 430 each have temperature sensors 318, whose signals can be detected by means of a measured-data detection unit 320, which can be read by the computer system 310.

Analogously to the description relating to FIG. 3, the method according to the invention can also be implemented with the arrangement illustrated in FIG. 4. Once again, a plurality of power levels are assigned to the electrical load elements 418, 420, 432 and 438. As described above, in this case as well, these power levels can be predetermined in a fixed form at this stage in the form of electrical circuits, for example in the power controllers 452, 454, 456 and 458, between which it is just necessary to switch in order to apply the appropriate power levels to the load elements 418, 420, 432 and 438.

In the starting phase of the dishwasher 410, the washing liquid in the tank for the washing lye 416 must first of all be heated to the operating temperature. This washing lye is required first of all during operation, followed by the fresh water 430. Thus, analogously to the method described above, the heating element 418 once again first of all has an electrical power corresponding to the maximum power level applied to it, while in contrast lower power levels are applied to the other load elements 420, 432 and 438. For example, the pumps 420, 438 can thus be switched off completely in this starting phase, that is to say they have zero power applied to them. Since the fresh water 430 is also required at an increased temperature during operation, it is, however, worthwhile not completely setting the power level for the heating element 432 to zero, so that the fresh water 430 in the fresh-water tank 426 is also slowly heated up, in order to be available later during rinsing operation.

As soon as the temperature sensor 318 and the measured-data detection unit 320 signal that the temperature in the washing lye tank 416 has reached the desired temperature, the computer system 310 starts the switched-on phase, and the dishwasher 410 is ready to operate. The regular power levels are then applied to the load elements 418, 420, 432 and 438. The further operating phases, which have already been described above, can also be carried out in a corresponding manner using the energy-saving method according to the invention. In this case, it should be noted that the regular power levels for the individual load elements 418, 420, 432 and 438 may be chosen to be different in the different operating phases of the dishwasher 410. For example, the regular power level of the fresh-water pump 438 in the phase of cleaning the item 414 to be washed with washing lye from the tank 416 can thus be set to zero, since no fresh water 430 is applied to the item 414 to be washed in this phase. The regular power of this pump 438 is then reduced in a corresponding manner during rinsing operation. Alternatively, the regular power level for this pump may, however, also be kept constant.

The method can thus be matched in a simple manner to the various operating phases of the single-chamber dishwasher 410. Load regulation in the event of a discrepancy between the individual operating parameters and their respective nominal values during operation can be carried out in a manner corresponding to the method according to the invention as described above.

TABLE 1

Typical electrical power levels for the loads in a dishwasher corresponding to the prior art, during normal operation:

| | |
|---|---|
| Heating for precleaning 14 | 12 kW |
| Heating for main cleaning 18 | 9 kW |
| Heating for pump rinsing 22 | 3 kW |
| Heating for continuous-flow heater 26 | 8 kW |
| Heating for drying 33 | 9 kW |
| Pumps 15, 19, 23 | 2 kW each = 6 kW |
| total power | 47 kW |

TABLE 2

Examples of power applied to individual loads on the basis of the method according to the invention, in comparison to the prior art:

| | $p_{imax}$ $p_{ireg}$ $p_{imin}$ | Starting phase | Switched-on phase | Load regulation phase | Prior art |
|---|---|---|---|---|---|
| Heating for precleaning (14) | 24<br>9<br>0 | 24 | 9 | 0 | 24 |
| Heating for main cleaning (18) | 15<br>6<br>0 | 15 | 6 | 15 | 15 |
| Heating for pump flushing (22) | 6<br>2<br>0 | 6 | 2 | 6 | 6 |
| Heating for continuous-flow heater (26) | 18<br>16<br>0 | 0 | 16 | 16 | 18 |
| Heating for drying (33) | 9<br>6<br>0 | 0 | 6 | 0 | 9 |
| Pumps (15, 19, 23) | 6<br>6<br>0 | 0 | 6 | 6 | 6 |
| Sum | | 45 kW | 45 kW | 43 kW | 78 kW |

LIST OF REFERENCE SYMBOLS

1 Inlet zone
2 Precleaning zone
3 Main cleaning zone
4 Pump rinsing zone
5 Fresh-water rinsing zone
6 Heat recovery zone
7 Dry zone
8 Outlet zone
9 Item being washed
10 Transport device, item being washed
11 Transport device, for example endless belt
12 Inlet trough
13 Tank for cleaner solution
14 Heating for precleaning
15 Pump for precleaning
16 Spraying system for precleaning
17 Tank for cleaner solution for main cleaning
18 Heating for main cleaning
19 Pump for main cleaning
20 Spraying system for main cleaning
21 Tank for solution, pump rinsing zone
22 Heating for pump rinsing zone
23 Pump for pump rinsing zone
24 Spraying system for pump rinsing zone
25 Continuous-flow heater for fresh-water rinsing
26 Heating, continuous-flow heater for fresh water
27 Mains connection for fresh water
28 Spraying system for fresh-water rinsing
29 Heat exchanger, exhaust air/fresh water
30 Exhaust air fan
31 Direction of the air flow
32 Fan in the dry zone
33 Heating in the dry zone
34 Direction of the air flow
35 Outlet trough for removal of the item being washed
110 Multiple chamber dishwasher
210 Assignment of an electrical total power $p_{max}$
220 Assignment of power levels $p_{ij}$
230 Determination of the optimum combination of power levels $p_{ij}$
240 Setting of the power $p_{ij}(B)$ for each load element
310 Computer system
312 Central processor unit
314 Data memory
316 Main control line
318 Temperature sensors
320 Measured data detection unit
322 Electrical power supply
324 Electrical power supply
326 Electrical power supply
328 Electrical power supply
330 Electrical power supply
332 Externally controllable electrical power regulator
334 Externally controllable electrical power regulator
336 Externally controllable electrical power regulator
338 Externally controllable electrical power regulator
340 Externally controllable electrical power regulator
410 Single-chamber dishwasher
412 Basket
414 Item being washed
416 Tank for washing lye
418 Heating element for washing lye
420 Circulation pump
422 Washing system for washing lye
424 Nozzles for washing lye
426 Fresh-water tank boiler
428 Filling valve
430 Fresh water
432 Heating element for fresh-water tank
434 Coverage level
436 Vent line
438 Induction pump
440 Washing system for fresh water
442 Nozzles for rinsing
444 Electrical power supply
446 Electrical power supply
448 Electrical power supply
450 Electrical power supply
452 Externally controllable electrical power regulator
454 Externally controllable electrical power regulator
456 Externally controllable electrical power regulator
458 Externally controllable electrical power regulator

The invention claimed is:

1. A method for energy-saving operation of a dishwasher, with the dishwasher having a total number $N \geqq 2$ of electrical load elements, having the following steps:

a) a group of n electrical load elements is assigned a maximum electrical total power $p_{max}$;

b) each electrical load element i in the group of n electrical load elements is assigned a finite number $m_i$ of discrete electrical power levels $p_{ij}$ where $m_i \geqq 2$:

with there being a maximum power level $p_{imax}$ for each i, where $p_{ij} \leqq p_{imax}$, where the sum of all maximum power levels $p_{imax}$ form a worst total power $$p_{worst} = \sum_{i=1}^{n} p_{imax} \text{ where } p_{max} < p_{worst},$$

and where a regular power level $p_{ireg}$ exists for each i, where $0 < p_{ireg} < p_{imax}$ for all i, j, and where $$\sum_{i=1}^{n} p_{ireg} = p_{max};$$

c) an optimum combination of power levels $p_{ij}$ is selected in a demand determination step, as a function of an operating state B of the dishwasher, where the selected power level $p_{ij}$ for each i is matched to the power demand of the load element i in the operating state B, and where:

$$\sum_{i=1}^{n} p_{ij}(B) \leq p_{max},$$

for all operating states B;

d) the electrical power of each load i in the group of n electrical load elements is set to the power level $p_{ij}$, with the maximum power level $p_{imax}$ being assigned, at least during one of the operating states of the dishwasher, to at least one load element in the group of n electrical load elements; and in a load regulation phase, at least one load element r, where $r \in \{1, \ldots, n\}$ and which influences at least one operating state variable, which differs by more than a predetermined tolerance from a nominal value thereof, is operated at a power level which differs from its regular power level $p_{rreg}$, until the at least one operating state variable once again assumes a value which differs by not more than the predetermined tolerance from its nominal value.

2. The method as claimed in claim 1, characterized in that a power level $p_{ik}$ exists for each electrical load i, where $0<k \leqq m_i$ and where $p_{ik}=0$.

3. The method as claimed in claim 1, characterized in that $m_i=3$ for all i.

4. The method as claimed in claim 1, characterized in that the following method steps are additionally carried out:

e) the dishwasher is started, as a result of which a starting phase begins;

f) at least one temperature of at least one washing liquid, is detected;

g) the at least one washing liquid is heated, where at least one heating element which heats the washing liquid and forms the load element l where $l \in \{1, \ldots, n\}$ is operated at the maximum power level $p_{imax}$ associated with this heating element, and where at least one load element q which is not the same as the heating element and where $q \in \{1, \ldots, n\}$ and $q \neq 1$ is operated at a lower power than the regular power level $p_{qreg}$ associated with this load element q; and h) as soon as the at least one temperature of the at least one washing liquid has reached or exceeded a predetermined nominal value, a switched-on phase is started, where the power of all the load elements i is set to the respectively associated regular power level $p_{ireg}$.

5. The method as claimed in claim 4, having the following additional steps:

i) at least one operating state variable is detected;

j) at least one operating state variable is allocated a nominal value; and k) as soon as the value of the at least one operating state variable differs from the respectively associated nominal value by more than a predetermined tolerance, a load regulation phase is started.

6. The method as claimed in claim 1, characterized in that, in method step c), each load element is allocated a priority, and in that the optimum combination of the power levels pij(B) is determined taking into account the priorities of the load elements.

7. The method as claimed in claim 6, characterized in that heating elements which heat washing liquid, is allocated a higher priority than other loads.

8. The method as claimed in claim 1, characterized in that all of the operating states B are characterized by an operating phase variable F and/or by a plurality of operating state variables, where the operating state variable F can assume at least three discrete values ($F_1$, $F_2$, $F_3$), where $F_1$ denotes a starting phase for operation of the dishwasher, where $F_2$ denotes a switched-on phase for operation of the dishwasher, and where $F_3$ denotes the load regulation phase for operation of the dishwasher.

9. A computer program having computer-readable program code stored on a non-transitory computer-readable data storage medium, the program, when executed, carrying out a method as claimed in claim 1, when the computer program is run on a computer or computer network.

10. A computer program stored on a non-transitory computer-readable data storage medium, the program, when executed, causing a computer to carry out the method recited in claim 4.

11. An apparatus for energy-saving operation of a dishwasher, with the dishwasher having a total number $N \geqq 2$ of electrical load elements, having:

a) means for assignment of a maximum electrical total power $p_{max}$ to a group of n electrical load elements;

b) means for assignment of a finite number $m_i$ of discrete electrical power levels $p_{ij}$ to each electrical load element i in the group of n electrical load elements, with there being a maximum power level $p_{imax}$ for each i, where $p_{ij} \leqq p_{max}$, where the sum of all maximum power levels $p_{imax}$ form a worst total power $$p_{worst} = \sum_{i=1}^{n} p_{imax} \text{ where } p_{max} < p_{worst},$$

and where a regular power level $p_{ireg}$ exists for each i, where $0<p_{ireg}<p_{imax}$ for all i, j, and where $$\sum_{i=1}^{n} p_{ireg} = p_{max};$$

c) means for selection of an optimum combination of power levels $p_{ij}$, as a function of an operating state B of the dishwasher, where the selected power level $p_{ij}$ for each i is matched to the power demand of the load element i in the operating state B, and where:

$$\sum_{i=1}^{n} p_{ij}(B) \leq p_{max},$$

for all operating states B;

d) means for setting the electrical power of each load i in the group of n electrical load elements to the respective power level $p_{ij}(B)$, with the maximum power level $p_{imax}$ being assigned, at least during one of the operating states of the dishwasher (110; 410), to at least one load element in the group of n electrical load elements; and means for operation of at least one load element r, where $r \in \{1, \ldots, n\}$ which influences at least one operating state variable, which differs by more than a predetermined tolerance from a nominal value thereof at a power level, which differs from its regular power level $p_{rreg}$, in the load regulation phase, until the at least one operating state variable once again assumes a value which differs from its nominal value by not more than the predetermined tolerance.

12. The apparatus as claimed in claim 11, additionally having:

e) means for starting the dishwasher by which means a starting phase is started;

f) means for detection of at least one temperature of at least one washing liquid;

g) at least one heating element, which heats the at least one washing liquid and forms the load element l where $l \in \{1, \ldots, n\}$, as well as means for operation of the at least one heating element at the maximum power level $p_{imax}$ associated with this heating element, as well as means for operation of at least one load element q, which is not the same as the at least one heating element, where $q \in \{1, \ldots, n\}$ and $q \neq 1$ at a lower power than the regular power level $p_{qreg}$ associated with this load element q; and h) means for starting a switched-on phase as soon as the at least one temperature of the at least one washing liquid has reached or exceeded a predetermined nominal value, where the power of all the load elements i is set to the respectively associated regular power level $p_{ireg}$.

13. The apparatus as claimed in claim 12, additionally having:

i) means for detection of at least one operating state variable;

l) means for assignment of in each case one nominal value to at least one operating state variable; and m) means for starting a load regulation phase as soon as the value of the at least one operating state variable differs by more than a predetermined tolerance from the respectively associated nominal value.

14. The apparatus as claimed in claim 11, characterized in that the means c) for selection of an optimum combination of power levels $p_{ij}$ have means for allocation of a priority to each load element as a function of an operating state B of the dishwasher, where the optimum combination of the power levels pij is determined taking into account the priorities of the load elements.

15. The apparatus as claimed in claim 11, characterized in that the dishwasher is a multiple tank dishwasher.

16. The apparatus as claimed in claim 11, characterized in that the means b) for assignment of a finite number mi of discrete electrical power levels pij to each electrical load element and/or the means c) for selection of an optimum combination of power levels pij as a function of an operating state B of the dishwasher have/has a look-up table and/or an electronic table.

* * * * *